United States Patent [19]

Magnuson

[11] 4,213,576

[45] Jul. 22, 1980

[54] SPOOL MAKING MACHINE

[76] Inventor: Lars Magnuson, Gräfsnäs Säteri, 46030 Sollebrunn, Sweden

[21] Appl. No.: 45,135

[22] Filed: Jun. 4, 1979

[30] Foreign Application Priority Data

Jun. 5, 1978 [SE] Sweden ..... 7806545

[51] Int. Cl.[2] ..... B65H 17/02

[52] U.S. Cl. ..... 242/67.3 R

[58] Field of Search ..... 242/67.3 R, 67.1, 67.2; 53/118

[56] References Cited

U.S. PATENT DOCUMENTS

| | | | |
|---|---|---|---|
| 2,184,744 | 12/1939 | Jonassen | 242/67.2 |
| 3,191,882 | 6/1965 | Riedel | 242/67.3 R |
| 3,360,210 | 12/1967 | Frisbie | 242/67.3 R X |
| 3,749,330 | 7/1973 | Gazzola | 242/67.3 R |

*Primary Examiner*—Edward J. McCarthy

*Attorney, Agent, or Firm*—Cantor and Singer

[57] ABSTRACT

A device for maintaining a tensioning in an elongate strip of plastics, when transferring the latter from one station to an other, located to opposite sides of a machine distributing slices of foodstuff upon the strip, includes, at the first station, a dispensing device arranged in conjunction to a strip storage roller, and provided with a pivotably suspended, motor-driven feed roller cooperating with a pinch roller. The second station comprises a shaft adapted to carry at least one tubular core for receiving the strip and is driven by a motor by way of a slipping clutch, which permits a somewhat higher speed than that of the feed roller at the first station.

The shaft is preferably designed to carry two tubular cores, and extends cantileverwise from a bearing device. A hub receiving an inward core encloses and carries, together with a driving pinion, part of the shaft, the pinion being mounted upon a trunnion which, in turn, is journalled in the bearing device.

9 Claims, 5 Drawing Figures

SPOOL MAKING MACHINE

BACKGROUND OF THE INVENTION

When handling sliced foodstuff, especially of the kind intended to be used when making sandwiches, it is customary to distribute the slices, one after the other, upon an elongate strip of plastics, which is then wound to a spool. In such a manner an easily handled unit is obtained, where the slices are well protected, and which permits an easy serving-out.

On many occasions the preparation of these spools mean a handling of large quantities, and it is desirable that the slice receiving machine permits a high and even speed at the strip. To make the machine operate efficiently, producing equal and even spools it is important that the strip of plastics is maintained taut just where the slices are distributed upon the strip. This is especially important when two, or more, parallel strips are involved.

The plastics material is usually supplied in big reels, and it will be necessary to meter out the strip from such a reel, carried adjacent to a first station, and feed it to a second station, where the strip is wound up to spools. During the passage from the first station to the receiving station the strip will pass a device distributing slices of the desired foodstuff upon the strip, so the slices will be wound up upon the spool together with the strip.

SUMMARY OF THE INVENTION

The aim of the present invention is to propose a mechanism, where the operation at the two stations is coordinated in such a manner that a tensioning is maintained in the strip, when the latter passes between the two stations.

The invention is characterized in that the first station comprises a storage reel connected to a dispensing device comprising a suspended driven feed roller and a fixed pinch roller cooperating therewith, and that the second station comprises a shaft adapted to receive at least one tubular core of a receiving reel, and being driven by a motor by way of a slipping clutch, said motor being designed to permit rotation of the shaft at a higher speed than that of the feed roller of the first station.

The feed roller is preferably, together with an idling roller, mounted upon a pair of pivotable arms.

The second station is preferably adapted to carry two tubular cores, and extends cantileverwise from a supporting bearing device at one of its ends, the end of said shaft remote from said bearing device having a hub adapted to receive a first tubular core, while a further hub for an inward tubular core, together with a driving pinion rotatably encloses a portion of the shaft, the pinion being mounted upon a trunnion which in turn is journalled in the bearing device.

The shaft and the trunnion are preferably driven by the same power source, a slipping clutch being provided in each transmission path.

The ends of the two hubs turned towards each other are preferably provided with guides facilitating the transfer of a tubular core along the outward hub to the inward hub.

A device monitoring the operation of the two power sources is preferably adapted to stop said power sources, should the plastics strip break.

DESCRIPTION OF A PREFERRED EMBODIMENT

Figure 1:
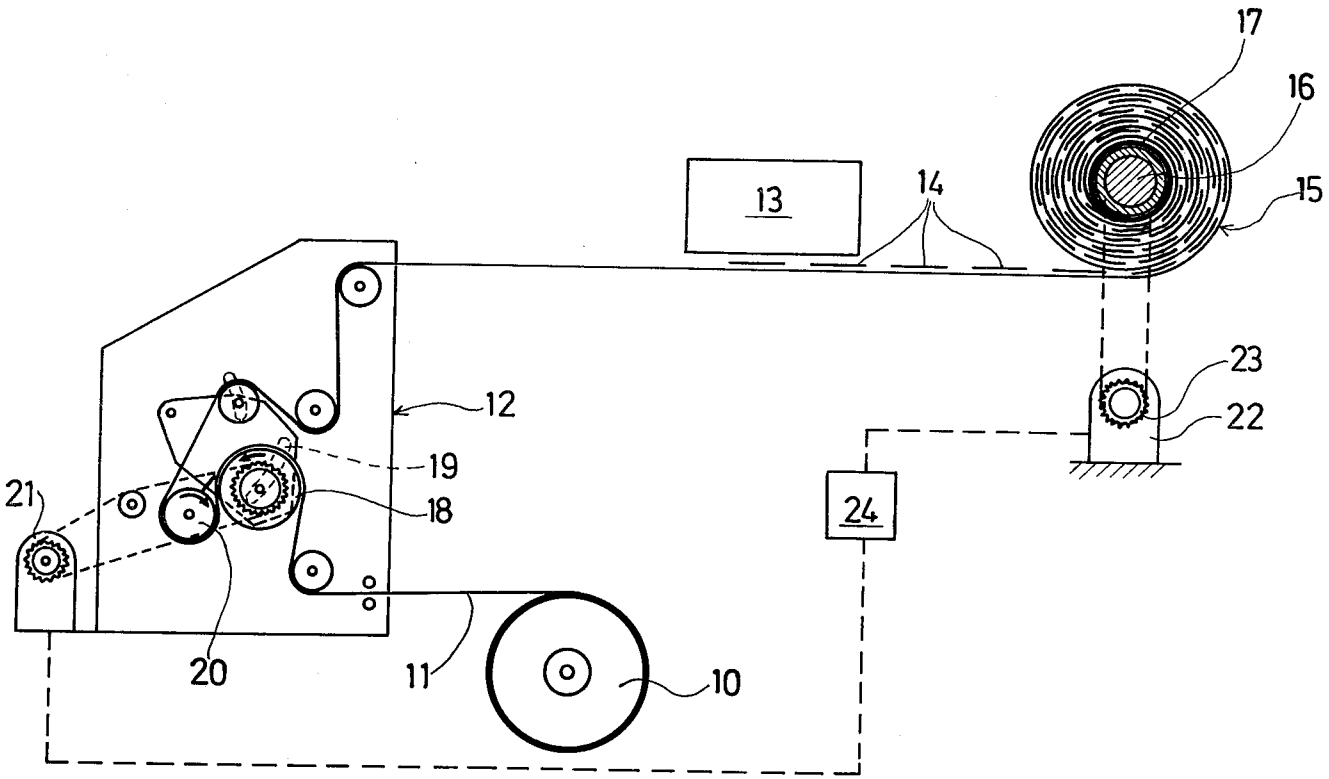
FIG. 1 schematically shows a machine for handling sliced sandwich filling and comprising a strip dispensing station and a filled strip receiving station.

The machine shown in FIG. 1 is adapted to distribute sliced foodstuff, such as sandwich fillings, prepared in any suitable manner (not shown) upon an elongate strip of plastics, which is then wound up to a spool.

A storage reel containing plastics film cut to an elongate strip is denoted by 10. The plastics strip 11 is transferred through a first station containing a dispensing device 12. From the latter the strip 11 is brought to pass past a machine 13, which delivers slices 14 of sandwich fillings upon the strip 11, as the latter passes the machine. It is important that the speed of the strip corresponds with the capacity of machine 13, and also that the strip is maintained taut.

The filled strip 11 is then brought to a second station 15, comprising a rotatable shaft 16. This is adapted to receive a tubular core 17 upon which the strip will be wound.

The dispensing device 12 includes a feed roller 18, the shaft of which is mounted in grooves 19 so it may be moved with respect to a pinch roller 20, which is journalled in fixed bearings. The path of strip 11 through the feeding device 12 will bring it substantially all around feed roller 18 and between the latter and pinch roller 20.

Feed roller 18 is driven by a power source 21, and as the strip is pinched between rollers 18 and 20 the speed of the feed roller will meter out a certain length of strip per unit of time from the storage reel 10.

Figure 2:
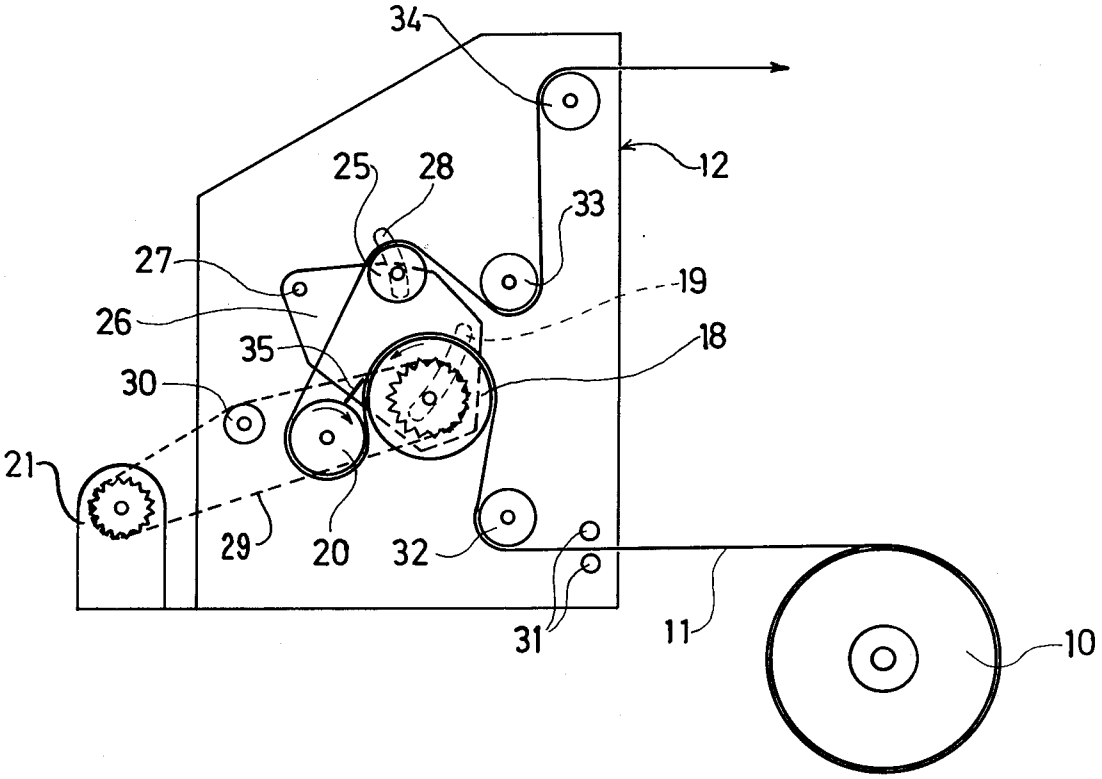
FIG. 2 shows the dispensing station more in detail.

Further details at the dispensing device 12 will be apparent from the description pertaining to FIG. 2.

Shaft 16 at the receiving station 15 is driven by a second power source 22. The characteristics for the power sources and the associated transmissions are so selected that the input to shaft 16 will occur at a higher speed than at roller 18, for instance 20% higher. As the feeding speed at station 12 is fixed, a slipping clutch 23, of arbitrary known type, is provided between power source 22 and shaft 16.

Power sources 21 and 22 are monitored in any suitable known manner and are interconnected by a device, schematically denoted at 24, which stops both power sources should the strip break. Micro-switches (not shown) are located at suitable positions within the machine, to sense i.a. when the storage reel 10 has been emptied, or when the diameter of the spool formed upon shaft 16 has reached a certain, predetermined magnitude.

The dispensing device 12 is shown more in detail in FIG. 2. The feed roller 18 is, together with an idling roller 25 carried by arms 26, which are swingable about pivot 27. The housing of the feeding device is provided with the grooves 19, mentioned above, for the shaft of roller 18, and also with corresponding grooves 28 for the shaft of roller 25. The grooves 19 and 25 are arcuate and concentric with pivots 27. The arms 26 will together with rollers 18 and 25 represent a considerable weight, which ensures a definite pinching of strip 11 between rollers 18 and 20.

The metering out of strip from the storage reel 10, will thus be exactly determined by the rotation of roller 18. The latter is driven from power source 21 by way of a chain transmission 29 containing a tensioning device 30.

At the entrance side of the housing a guide 31 is provided, which ensures that the strip will enter the housing at substantially the same level, independently of the decrease of the diameter of storage reel 10, as the strip is used up. Downstream of guide 31 there is a fixed guide roller 32, which is located so the strip 11 will be brought about so far inward as to pass the adjacent part of the periphery of feed roller 18. The strip will thus, in use, encircle a substantial part of the periphery of the feed roller.

Downstream of the movable idling roller 25 there are two rollers 33 and 34, carried in fixed journals, and the strip will leave the latter in a horizontal direction towards machine 13.

At the downwardly rotating side of feed roller 18 there is an inclined guide plate 35, located above pinch roller 20. The object of this guide plate is to catch a portion of the strip 11 between rollers 20 and 25, if the strip breaks, or if the strip, due to some fault at the receiving station, should slacken so much, that the occasional portion of the strip between rollers 20 and 25 would hang down between feed roller 18 and pinch roller 20. The portion of the strip, already fed out, would then be pulled backwards into the dispensing device 12, and completely block the operation thereof.

Figure 3:
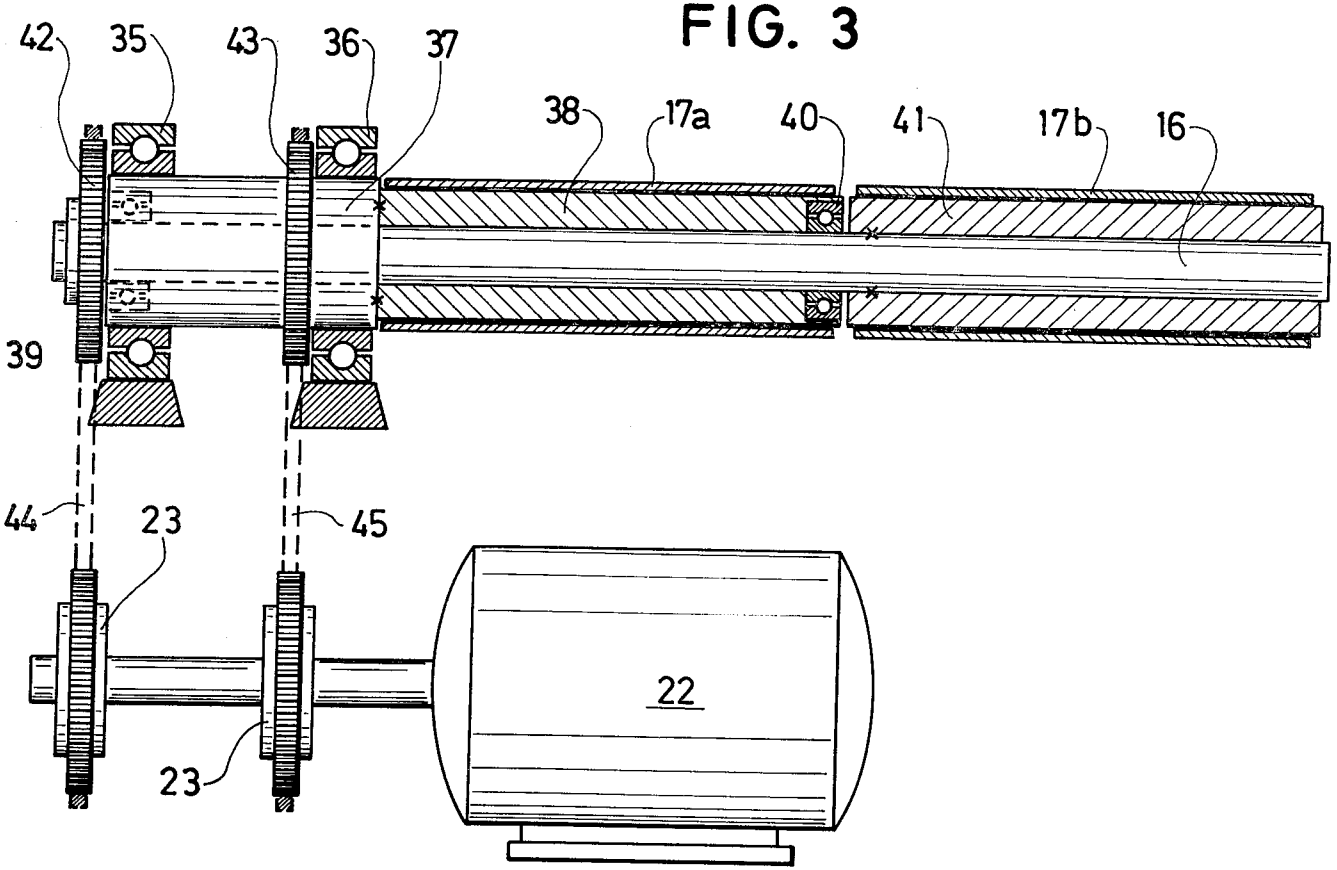
FIG. 3 shows the receiving station.

The receiving station shown in FIG. 3 is adapted to operate with two tubular cores 17*a*, 17*b*, and it is evident that on such occasion the storage roller 10 and the dispensing device 12 are adapted to pass two parallel strips past machine 13 to the receiving station.

Shaft 16 is indirectly carried in a bearing device comprising two, spaced apart ball bearings 35, 36, which enclose a trunnion 37. An elongate hub 38, adapted to receive one tubular core (17*a*) is attached to this trunnion.

The shaft proper 16 is carried by a first bearing 39 within trunnion 37, and a second bearing 40 at the end of hub 38 located away from trunnion 37. Shaft 16 extends beyond trunnion 37 as well as hub 38, and carries, outside of the latter, a further hub 41 adapted to receive a second tubular core (17*b*).

The shaft with the hubs extends cantileverwise from the bearing device 35, 36 and it is easy to introduce and remove cores 17 at the free end of the shaft.

The shaft 16 is provided with a driven pinion 42 located outside of trunnion 37 and the latter is provided with a driven pinion 43.

Transfer of torque to pinions 42, 43 is arranged by means of chain transmissions 44, 45, which each contains a slipping clutch 23, mentioned above, which makes it possible to keep the strip taut, due to the fact that power source 22 permits a somewhat higher speed input than power source 21.

The diameter of the storage roller will decrease continously, but the feed roller will meter out a constant length per unit of time. The diameters of the spools will on the other hand increase rapidly due to the addition of the foodstuff slices. The input speed to the shaft 16 must therefore be higher than the speed at the feed roller 18, and the slipping clutch 23 will automatically adjust the rotation of the shaft so the peripheral speed at the spool provides the desired tensioning of the strip metered out by the feed roller.

The tubular cores 17 are introduced upon hubs 38, 41 at the free end of the shaft, and an inward core 17*a* must pass hub 41 in order to reach hub 38.

Figure 5:
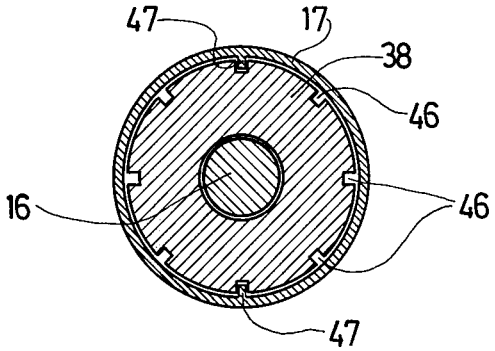
FIG. 5 shows a section along line V—V in FIG. 4.

The cross sectional shape of the hubs will be evident from FIG. 5. Each hub is provided with a number of axially running grooves 46, in the embodiment shown there are eight grooves.

Each tubular hub 17 is internally provided with two axially running ledges 47, which makes it possible to mount the core upon the hub in a number of axial positions, but with a driving engagement in relation to the hub. The core is furthermore, at least at portions of its outward envelope face, roughened which makes it possible to attach the plastics strip thereto by putting an end of the strip upon the core and apply a slight pressure thereon. The roughened surface at the hub will then take a hold on the strip, and the latter will be wound upon the core as soon as the hub starts rotating.

Figure 4:
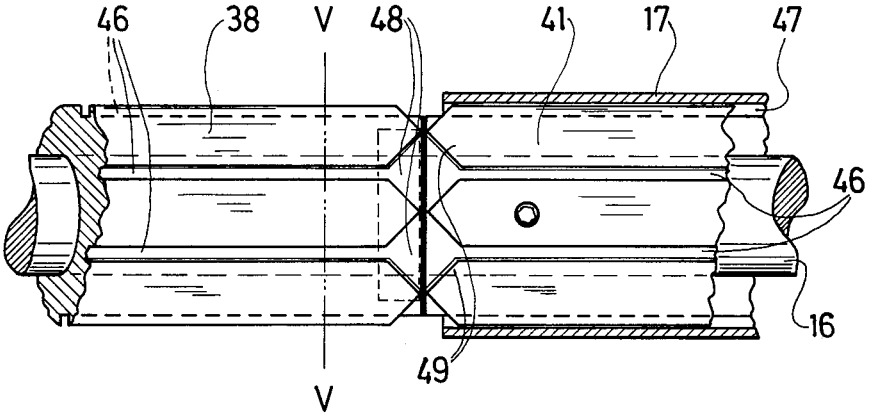
FIG. 4 shows a detail, forming part of FIG. 3.

The ends of the grooves 46 at the portions of the hubs 38, 41 turned towards each other are funnel-shaped at 48 and 49, respectively, (vide FIG. 4). Even if the hubs, after a receiving operation, should terminate their rotations at different angular positions it will be possible to remove core 17*a* when core 17*b* has been removed. The ledges 47 at core 17*a* will be caught by the funnel-shaped mouths 49 of hub 41, which causes a relative turning action at the hubs, so core 17*a* may continue outwards over hub 41.

The opposite will of course happen when the empty cores are introduced, core 17*a* being brought in first, and the funnelshaped mouths 48 forcing the hubs into proper alignment.

The shown embodiment must be regarded as an example only, as the shape and size of the components may vary in many ways within the scope of the appended claims.

It is thus possible to arrange more than two hubs in series at shaft 16 and in the dispensing device 12 additional weights may be applied at the feed roller 18 or at the arms 26 in order to increase the pressure upon the pinch roller 20. Power sources 21 and 22 preferably are electric motors.

What I claim is:

1. A machine for making spools of plastics strip carrying slices of foodstuff and comprising a first station having means to support a storage reel for said strip as well as a dispensing device, the latter including a feed roller and a cooperating pinch roller, said feed roller being mounted in means ensuring a contact pressure between said feed roller and said pinch roller, and a first power source for driving said feed roller at a constant speed, a second station, spaced apart from said first station and including a rotatable shaft having means for removably receiving at least one tubular spool receiving core, a second power source for driving said shaft at a nominally higher speed than that of said feed roller, and a slipping clutch transmission between said second power source and said shaft for adjusting the actual speed of said shaft in response to the length of strip feed out by said feeding device, and a machine located between said first and said second station, to distribute slices of foodstuff upon said strip while being passed from said first to said second station.

2. The mechanism according to claim 1, in which said feed roller, together with an idling roller is mounted upon a pair of pivotable arms.

3. The mechanism according to claim 2, in which the dispensing device comprises two fixed guide rollers downstream of said feed roller.

4. The mechanism according to claim 1, in which an inclined catching plate is located between said feed roller and said pinch roller, inside of the issuing portion of the strip.

5. The mechanism according to claim 2, further including an entrance guide, adapted to direct the entering strip substantially uniformly, independently of the continuous decrease, in use, of the diameter of the storage reel.

6. The mechanism according to claim 1, in which the shaft at said second station is adapted to carry two aligned, tubular cores, and extends cantileverwise from a supporting bearing device at one of its ends, the end of said shaft remote from said bearing device having a first hub, adapted to receive a first tubular core, while a further hub for an inward tubular core, together with a driving pinion rotatably encloses a portion of said shaft, said pinion being mounted upon a trunnion which, in turn, is journalled in said bearing device.

7. The mechanism according to claim 6, in which said shaft and said trunnion are simultanously driven by said second power source, one slipping clutch being provided in each transmission path between said second power source and said shaft and said trunnion, respectively.

8. The mechanism according to claim 6, in which the ends of said two hubs, turned towards each other are provided with guides facilitating the transfer of a tubular core along an outward hub to an inward hub.

9. The mechanism according to claim 1, further including a device monitoring the operation of said two power sources and adapted to stop said power sources, should the plastics strip break.

* * * * *